United States Patent [19]

Bruskin

[11] Patent Number: 4,890,776

[45] Date of Patent: Jan. 2, 1990

[54] NEEDLE THREADING DEVICE

[76] Inventor: Mark Bruskin, 376 Madison St., New York, N.Y. 10002

[21] Appl. No.: 297,330

[22] Filed: Jan. 17, 1989

[51] Int. Cl.[4] ..... D05B 87/02

[52] U.S. Cl. ..... 223/99

[58] Field of Search ..... 223/99; 112/225

[56] References Cited

U.S. PATENT DOCUMENTS

| | | | |
|---|---|---|---|
| 2,382,079 | 8/1945 | Lounsbury | 223/99 |
| 2,679,959 | 6/1954 | Ullisperger | 223/99 |
| 2,711,272 | 6/1955 | Gerstein | 223/99 |
| 4,492,325 | 1/1985 | Biemans | 223/99 |

FOREIGN PATENT DOCUMENTS

| | | | |
|---|---|---|---|
| 1018919 | 1/1953 | France | 112/225 |
| 1048724 | 12/1953 | France | 223/99 |
| 1066463 | 6/1954 | France | 223/99 |
| 1108740 | 1/1956 | France | 223/99 |

*Primary Examiner*—Werner H. Schroeder
*Assistant Examiner*—David K. Suto
*Attorney, Agent, or Firm*—Ilya Zborovsky

[57] ABSTRACT

A needle threading device has a passage for a needle, a recess for a thread, and a threader turnable by a user and pushing the thread from the recess into the passage and thereby into the ear of the needle. The threader turns between two pins which simultaneously form connectors for connecting two housing parts of the device. A cutter is attached to the housing, and the housing has an attaching element for attaching the device for a piece of the user's clothes.

13 Claims, 1 Drawing Sheet

NEEDLE THREADING DEVICE

BACKGROUND OF THE INVENTION

The present invention relates to a needle threading device of the type having a needle threader member which is manually operable to displace a thread through the eye of a needle supported in a passage of the device.

Manually operable devices of the above mentioned general type are known in the art. One of such devices is disclosed for example in the U.S. Pat. No. 4,492,325. While the known devices reliably performs its intended function, it possesses several disadvantages. The housing of the device is composed of two housing halves which are connected with one another by special connecting means which perform only the connecting function. The device is not provided with cutting means for cutting off the thread. The device also does not have means for attaching the device to the user's clothes. Finally, the housing of the device does not have a specialmeaning design.

SUMMARY OF THE INVENTION

Accordingly, it is an object of the present invention to provide a needle threading device which avoids the disadvantages of the prior art.

In keeping with these objects and with others which will become apparent hereinafter, one feature of the present invention resides, briefly stated, in a needle threading device in which pins for limiting the pivoting of a lever-type needle threader form simultaneously means for connecting two housing halves with one another.

In accordance with further features of the present invention a pivot pin for pivoting the lever-type needle threader and a pin for holding a restoring elastic member for the threader also form parts of the connecting means.

A further feature of the present invention, the device is provided with a cutter for cutting of the thread to be threaded in the needle.

Still another feature of the present invention is that the device has means for connecting the device to the user's clothes, formed as a clip or wire pin, etc.

The novel features of the present invention are set forth in particular in the appended claims. The invention itself, however, both as to its construction and its method of operation will be best understood from the following description of a preferred embodiment, which is accompanied by the following drawings.

DESCRIPTION OF A PREFERRED EMBODIMENT

Figure 1:
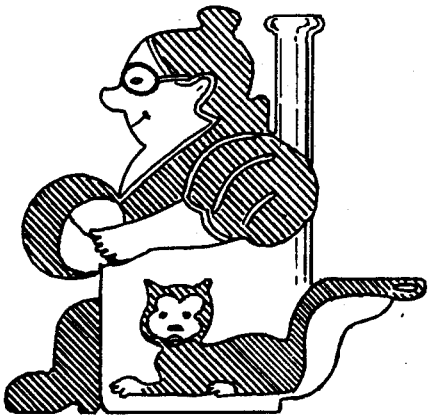
FIG. 1 is a side view of a needle threading device in accordance with the present invention.
Figure 2:
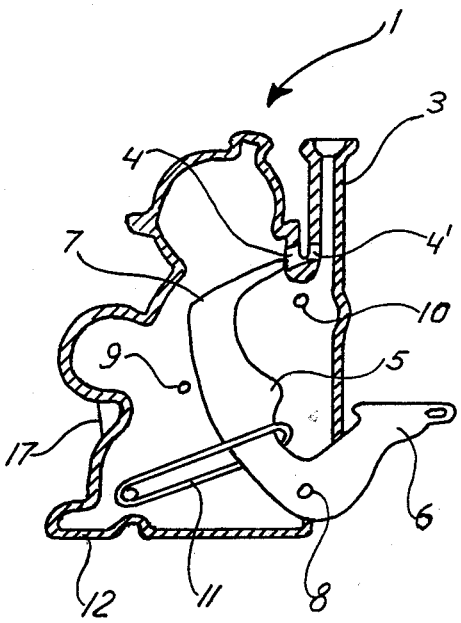
FIG. 2 is an inside view of one housing half of a housing of the inventive device.
Figure 4:
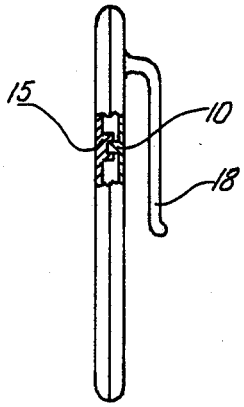
FIG. 4 is a view showing device attaching means in accordance with one embodiment.
Figure 3:
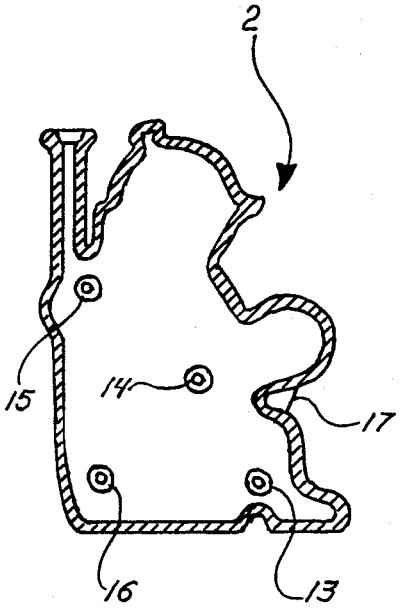
FIG. 3 is an inside view of another housing half of the housing.
Figure 5:
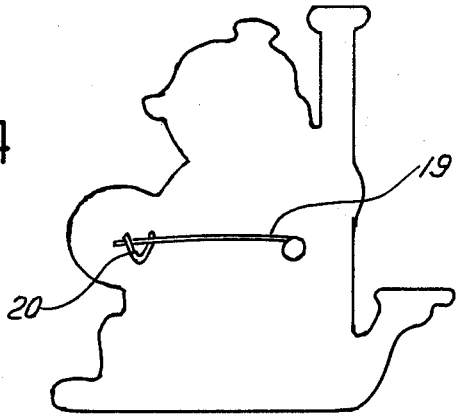
FIG. 5 is a view showing the attaching means in accordance with another embodiment.

A needle threading device in accordance with the present invention has a housing which includes two housing halves 1 and 2. The housing halves are shell-shaped and bounding an inner chamber therebetween.

The housing has a passage 3 for introducing a needle so that its ear faces downwardly. The housing further has a recess 4 for receiving a thread, which recess communicates with the passage through a short guide 4'. A needle threader is identified as 5 and formed as a lever. One end of the lever extends outwardly beyond the housing and is provided with a pedal 6. The other end of the lever has a thin projection 7. The lever is pivotally mounted on a pivot pin 8 which is integral with the housing half 1. The lever can pivot between two limiting pins 9 and 10 which are also integral with the housing half 1.

An elastic member 11 formed for example as a rubber band retains the lever in the shown position and has one end engaging the lever and another end fixed on a pin 12 which is integral with the housing half 1 as well.

The housing half 2 is provided with depressions 13, 14, 15 and 16 which upon placing the housing halves in abutment against one another, receive the ends of the pins 8, 9, 10 and 12 respectively with a snap action. Thereby the pins and depressions together form means for connecting the housing halves with one another, in addition to the above explained specific functions of the pins.

A cutter 17 is attached to the housing, for example by clamping the cutter between the housing halves. The cutter is used for cutting off a thread and located in a slot formed between two housing portions. More particularly, with the housing formed to imitate a person sitting on a chair, holding an object on its laps and accompanied by an animal, the cutter 17 is located in the slot between the laps and the object. In the housing having the above explained design, the passage 3 for the needle is formed in the back of the chair, while the recess 4 for the thread is formed between the back of the chair and the head of the person. This makes very convenient the respective operations of the needle threading.

The device is provided with means for attaching to a piece of user's clothes. This means can be formed as a clip 18 or a wire pin 19 cooperating with a wire loop 20.

The device operates in a known manner. The needle is inserted in the passage 3, the thread is inserted in the recess 4, and the lever 5 is turned by applying a pressure by a user to the pedal 6 so that the projection 7 pushes the thread through the guide 4' into the passage 3 and thereby into the ear of the needle.

The invention is not limited to the details shown since various modifications and structural changes are possible without departing in any way from the spirit of the present invention.

What is desired to be protected by Letters Patent is set forth in the appended claims:

1. A needle threading device, comprising a housing which bounds an inner chamber, said housing having a housing portion which forms an elongated passage for inserting a needle, said housing also having a receiving portion located close to said elongated passage and formed with a recess for receiving a thread, said recess communicating with said passage;

means for introducing a thread received in said recess into said elongated passage and therefore into an eye of a needle inserted in said passage, said introducing means including a pivotable lever having one lever portion which is permanently located outside of said housing and actuatable by a user and another lever portion, said lever being pivotable between a first position in which the other portion of said lever is completely confined in said housing and a second position in which an end of said other portion pushes a portion of a thread from said recess into said elongated passage and therefore through an eye of a needle located in said elongated passage; and means for limiting a path of pivoting of said lever and including two stops arranged so that one of said stops determines said first position while the other of said stops determines said second position, said housing being composed of two substantially similar halves which are connected with one another, said stops being formed integrally with one of said housing halves while the other of said housing halves is provided with two depressions which receive ends of said stops with a snap action so as to form means for connecting said housing halves with one another.

2. A needle threading device as defined in claim 1; and further comprising a cutting element attached to said housing for cutting a thread.

3. A needle threading device as defined in claim 2, wherein said housing has two further portions which form a slot therebetween, said cutting element being located in said slot between said further portions.

4. A needle threading device as defined in claim 3, wherein said housing is formed so that it has a shape of a person sitting on a chair and holding an object above its laps, said further portions are formed as the object and the laps so that said cutting element is located between the laps and the object.

5. A needle threading device as defined in claim 1, wherein said housing is formed so that it has a shape of a person sitting on a chair, said elongated passage being formed in a back of the chair, said recess being formed between a head of the person and the back of the chair.

6. A needle threading device as defined in claim 1, wherein said housing is formed so that it has a shape of a person sitting on a chair and an animal resting near its feet and having a tail, said one lever portion is formed as the tail of the animal.

7. A needle threading device as defined in claim 1; and further comprising means for returning said lever from said second position to said first position.

8. A needle threading device as defined in claim 7, wherein said returning means includes a resilient elastic element attached to said lever and having an opposite end which is fixed to said housing, so that during pivoting said lever from said first position to said second position in response to the actuation by a user said elastic element is stretched and then upon lifting an actuating force said elastic element compressed back and returns said lever to said first position.

9. A needle threading device as defined in claim 1; and further comprising a pivot pin on which said lever pivots between said first and second positions, said pivot pins being integral with one of said halves while the other of said halves has a depression which receives an end of said pivot pin with a snap action to form further connecting means for connecting said halves with one another.

10. A needle threading device as defined in claim 1; and further comprising a pin which holds said opposite end of said elastic element, said pin being integral with one of said halves of said housing while the other of said halves has a depression which receives an end of said pin which holds said opposite end with a snap action to form further connecting means for connecting said halves with one another.

11. A needle threading device as defined in claim 1; and further comprising means for attaching the device to a piece of user's clothes and including an attaching unit provided on said housing.

12. A needle threading device as defined in claim 11, wherein said attaching unit includes a clip attached to one of said halves of said housing.

13. A needle threading device as defined in claim 11, wherein said attaching unit includes a wire pin having one end fixed to said housing, and a wire loop engageable by another end of said wire pin.

* * * * *